US005590724A

United States Patent [19]

Verdgikovsky

[11] Patent Number: 5,590,724

[45] Date of Patent: Jan. 7, 1997

[54] UNDERREAMING METHOD

[75] Inventor: Alexander V. Verdgikovsky, deceased, late of Moscow, Russian Federation, by Elena S. Verdgikovskaya, legal representative

[73] Assignee: Russian-American Technology Alliance, Inc., Atlanta, Ga.

[21] Appl. No.: 255,417

[22] Filed: Jun. 8, 1994

[51] Int. Cl.[6] ..... E21B 7/28

[52] U.S. Cl. ..... 175/57; 175/292; 175/385; 175/406

[58] Field of Search ..... 175/57, 292, 267, 175/406, 385, 387

[56] References Cited

U.S. PATENT DOCUMENTS

| | | | |
|---|---|---|---|
| Re. 19,281 | 8/1934 | Schroeder . | |
| 836,494 | 11/1906 | Frieh et al. . | |
| 1,525,235 | 2/1925 | Hansen . | |
| 1,753,339 | 4/1930 | Hencken . | |
| 1,920,904 | 8/1933 | Hammer . | |
| 2,814,462 | 11/1957 | De Jarnett . | |
| 2,990,896 | 7/1961 | Kandle . | |
| 3,102,600 | 9/1963 | Jackson . | |
| 3,118,510 | 1/1964 | Kanady et al. . | |
| 3,376,922 | 4/1968 | Leonhardt, Jr. . | |
| 3,387,893 | 6/1968 | Hoever | 175/267 |
| 3,486,572 | 12/1969 | Hamilton et al. | 175/53 |
| 3,837,413 | 9/1974 | Dunn | 175/292 |
| 4,177,866 | 12/1979 | Mitchell | 175/53 |
| 4,194,578 | 3/1980 | Mitchell | 175/53 |
| 4,526,242 | 7/1985 | Mathieii et al. | 175/94 |
| 4,548,282 | 10/1985 | Hurtz et al. | 175/61 |
| 4,627,502 | 12/1986 | Dismukes | 175/320 |
| 4,822,221 | 4/1989 | Iiiakowicz | 409/309 |
| 5,180,209 | 1/1993 | Bieri | 299/41 |
| 5,230,388 | 7/1993 | Cherrington | 175/53 |

FOREIGN PATENT DOCUMENTS

| | | | |
|---|---|---|---|
| 1069881 | 1/1980 | Canada | 175/53 |
| 216042 | 7/1961 | Netherlands . | |
| 123108 | 9/1958 | Russian Federation | 175/267 |
| 120190 | 3/1959 | Russian Federation . | |
| 150806 | 4/1961 | Russian Federation | 175/267 |
| 148765 | 3/1962 | Russian Federation . | |
| 158852 | 3/1963 | Russian Federation . | |
| 153262 | 7/1963 | Russian Federation . | |
| 154833 | 11/1963 | Russian Federation | 175/267 |
| 160133 | 1/1964 | Russian Federation . | |
| 164000 | 9/1964 | Russian Federation . | |
| 180553 | 5/1966 | Russian Federation . | |
| 205746 | 3/1968 | Russian Federation . | |
| 224445 | 11/1968 | Russian Federation | 175/267 |
| 548704 | 3/1977 | Russian Federation | 175/267 |
| 626212 | 3/1978 | Russian Federation . | |
| 861611 | 3/1981 | Russian Federation . | |
| 1525266 | 11/1989 | Russian Federation | 175/292 |
| 1559171 | 4/1990 | Russian Federation | 175/53 |
| 1036926 | 8/1983 | U.S.S.R. . | |
| 1446315 | 12/1988 | U.S.S.R. . | |

OTHER PUBLICATIONS

One sheet of drawing comprising FIGS. 1–5, document No. 175–308, Nortensen Christeian Gasper inventor (1874).

*Primary Examiner*—Hoang C. Dang

*Attorney, Agent, or Firm*—James L. Ewing, IV, Esq.; Kilpatrick & Cody

[57] ABSTRACT

An underreamer which may be mounted on a core drill to allow single phase underreaming or creation of a bore hole of larger diameter beneath a pilot hole. A plurality of levers are powered by a plurality of corresponding jacks which are adapted to exert pressure on the levers in order to cause them to extend beyond the periphery of the expander body. Each lever contains at least one roller-cutter rotatably mounted to the lever so that when the levers are forced outward, the roller-cutters crush rock beyond the periphery of the expander body and thus underream the bore hole.

2 Claims, 5 Drawing Sheets

UNDERREAMING METHOD

The present invention relates to devices for sinking vertical openings of large diameter.

BACKGROUND OF THE INVENTION

There are four general conventional methods for sinking large diameter vertical openings. The first method involves complete destruction of the face. This method requires a massive bore hole probe with roller cutters which cover the entire surface area of the opening. The probe that powers such bits is massive and requires great power. This method is suitable primarily for soft rock or medium hard rock, such as up to 4 points of Protodiakonov scale. The drilling speed is very low in hard rock, the roller-cutters wear out quickly, and the method consequently entails high costs and low effectiveness for drilling in hard rock.

Second is the core drilling method. This method employs roller cutters on the periphery of a cylindrical probe, so that approximately 25–30 percent of the surface area of the opening is cut, primarily on the periphery. The main bulk of the rock is drawn to the surface as a core sample or block. The core sample is separated from the underlying rock (undercut) using convention methods such as shaped-charge shells, cable loops, tightening of the tackle-block system and other methods. This method utilizes core drills as bore hole probes and is useful primarily in hard rock and medium hard rock (up to 12 points of Protodiakonov scale).

The third method for sinking vertical openings of large diameter consists of gradual shaft underreaming. This technique is also known as phase drilling. The shaft is widened gradually using a drill of larger diameter in each phase. Conventional such underreamers have employed, for instance, intermediate phases of 3 m, 5.75 m, 7.5 m, and 8.75 m, for a final diameter of 8.75 m. The units utilized for underreaming may be thought of as a variation of the first method, and they thus share its disadvantages including low drilling speed, early wear of the cutters, high cost of drilling, and low effectiveness.

It is also known to employ a fourth technique for sinking large diameter holes. This technique uses roller-cutters which move inwardly in a plane perpendicular to the axis of the shaft. A conventional core drill may, for instance, be adapted to include levers and roller cutters. The drill itself may be a hollow cylinder with a lid in the upper part. The lower part of the cylinder may be a ring which features roller cutters and levers for core sample undercutting.

None of these techniques, however, permit underreaming of shafts in one phase or allow creation of a larger diameter hole through a small bore hole.

SUMMARY OF THE INVENTION

The present invention takes the form of an expander which may be secured to a core drill. The expander includes a number of levers, each of which may be used to position one or more roller cutters against the rock face by exerting pressure on the roller-cutters outside the periphery of the core drill and in a generally horizonal plane. A number of jacks which may be hydraulically powered and controlled actuate the levers to force the roller cutters against the face in order to underream.

The resulting underreamer allows underreaming in one phase, with minimum expenditure of energy according to a lightweight and efficient design and process.

It is accordingly an object of the present invention to provide an underreamer which allows speedy, efficient, reliable underreaming with minimum expenditure of energy.

It is an additional object of the present invention to provide an underreamer which may be employed to create openings of larger diameter through a smaller diameter bore hole.

Other objects, features, and advantages of the present invention will become apparent with respect to the remainder of this document.

DETAILED DESCRIPTION OF THE DRAWINGS

1. Work Forming A Basis For The Invention

The inventor, working for a very long time in the area of sinking vertical openings, observed that shaft sinking according to the second and third methods mentioned above would be greatly simplified with a device that allows the rock cutting to be performed by roller-cutters moving in the plane perpendicular to the axis (central line) of the rock opening.

With such a device in the core-drills, the undercutting of core samples from the rock mass becomes very simple. The roller-cutters move in the plane perpendicular to the drilling axis, from shaft's periphery to its center.

Implementation of such device in phase underreaming of the shafts makes it possible to avoid the use of bulky set of drills of different diameter, in order to underream a shaft in one phase, even when sinking hard rocks.

The principles of such rock cutting (drilling) by roller-cutters moving in the plane perpendicular to the axis (central line) of the shaft, was actually carried out on a specially designed derrick for core drilling designated UKB-3.6, manufactured in the USSR by the Ural plant of heavy machine building (UZTM), according to the author's design.

Main Characteristics of the UKB-3.6 Unit

| | |
|---|---|
| The Diameter of Drilling | 3.6 meters |
| The Depth of Drilling | Up to 1000 m |
| The Weight of Equipment | 800 tons |
| The Rotor Drive Capacity | 350 (kilo watts) |
| The Unit's Capacity | 1000 Kw |
| The Weight of Core Drill | 100 tons |
| The sizes of lifted core sample: | |
| Diameter | 3.1 M |
| Height | 5 m |
| Mass | 100 t |
| Rock Hardness | I = 12 (Protodiakonov Scale |

The main block of the derrick for core drilling UKB-3.6 was the core drill equipped with roller-cutters. The drill itself was a hollow cylinder with a lid in the upper part. In the lower part of the cylinder was a ring with sinking roller-cutters and levers for core sample undercutting.

Figure 5A:
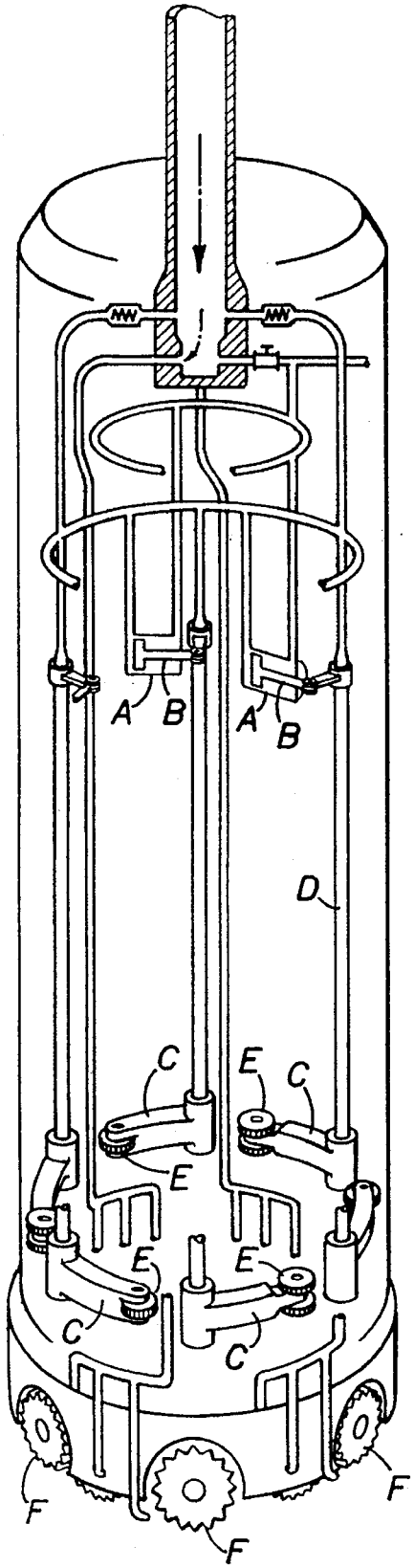
FIG 5A (PRIOR ART)
FIG. 5A and 5B show a conventional undercutter.
Figure 5B:
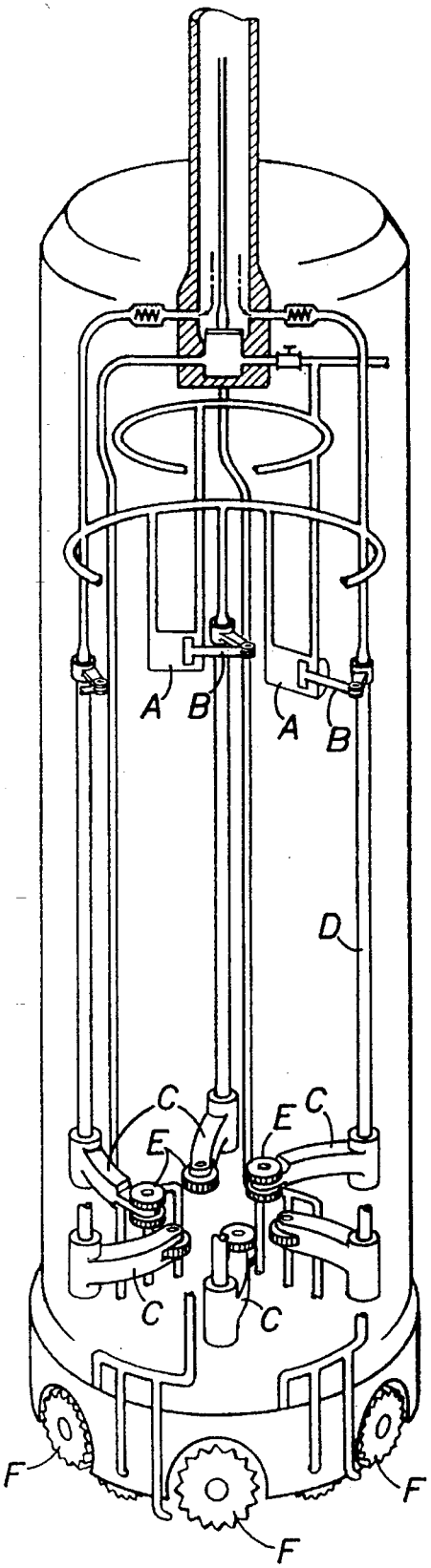
FIG 5B (PRIOR ART)

In drilling off of the core sample by sinking roller-cutters, the rock is crushed along the contour of the shaft, making a vertical circular slot, of the depth equal the height of the core sample. The drilled off core sample is then undercut by roller-cutters mounted on undercutting levers, which move in horizontal plane. FIG. 5A shows schematically the mechanism for core sample undercutting, with the undercutting levers and the roller-cutters in the off position, during the drilling off of the core sample. FIG. 5B shows the same mechanism, but with undercutting levers with roller-cutters positioned to undercut the core sample in the shaft.

The drilled off core sample is separated from the rock mass with the help of lever-roller-bit mechanism, consisting of hydraulic jacks A and rods B that are joined with undercutting levers C by rigid vertical shafts D. The roller-cutters E are fixed rotatably to the ends of the levers. After drilling off the entry of the shaft, the flush out fluid is pumped into the cylinders of hydraulic jacks, rods B turn the shafts D vertically, and levers C with roller-cutters start undercutting of the core sample. The core sample, separated from the rock mass, is picked up by levers and then drawn to the surface with the help of a winch and a tackle system.

The drilling of the shaft and the undercutting of the core sample are carried out with the use of flush-out-fluid which is selected depending on the type of the rock drilled. (As a rule they are clayish solutions with some additives). The circular slot is drilled out by main (sinking) roller-cutters E. The lever-roller-bit mechanism was operated by a hydraulic remote control.

The jacks were operated by flush-out-fluid, pumped along the drilling column through special hoses, under the pressure of 30 atm. The direct and reversal stroke of the jacks was controlled by a two position special valve, located in the upper part of the drilling barrel.

The width of the slot was 0.3m. Five shafts were drilled using UKB derricks with a diameter of 3.6 m and summarized depth of 1850 m (maximum depth of the shaft—650 m).

The undercutting was done on medium-hard and hard rock (up to 10 points of Protodiakonov scale). The control of the undercutting was carried out by conventional control devices and meters that were employed to control the power and rotating speed of the drilling column rotor.

The core samples were undercut every 5 meters of sinking. The hardness of the rock was specially estimated after each lifting of the core samples, by cutting out samples and compression tests in a laboratory.

In that way more than 370 (from about 3.1 m to about 0.5 m) undercuttings, created using roller cutters moving in the plane perpendicular to the central line of the shaft, were produced. Those drillings proved the normal operation of the pattern.

In Table I is given the average data on the undercutting speed, depending on the rock hardness, and the pressure in hydraulic jacks.

TABLE I

| AVERAGE CUTTING SPEED (M/HOUR) | | | |
|---|---|---|---|
| N/N | The Hardness of the Rock Points Of Protodiakonov | Under the Pressure of 20 ATM | Under the Pressure of 30 ATM |
| 1. | 2 (soft slate) | 0.73 | 0.85 |
| 2. | 4 (soft sandstone) | 0.52 | 0.68 |
| 3. | 6 (limestone of medium hardness) | 0.42 | 0.68 |
| 4. | 8–10 (limestone -sandstone) | 0.21 | 0.38 |

In the process of testing of the core drills, several improvements in roller-bit-lever mechanism were introduced and tested:

1. The diameter of vertical shaft was increased to increase torque transfer as follows: in the first shaft about 98 mm (the tube with the wall of 28 mm); in the second shaft about 125 mm (solid rod), and in the 3rd, 4th and 5th shafts about 160 mm (solid rod).

2. The method of hydraulic jacks operation and control was modified as follows: in the first shaft a ball valve was employed; in the 2nd, 3rd, 4th and 5th shafts a centrifugal inertial valve was employed.

3. The geometry and elements of fixing of the undercutting roller-cutters were modified.

4. The design of undercutting levers was modified. An additional roller-cutter was included in the design.

As a result of the improvements, the hydraulic lever mechanism for undercutting of core samples and the work of the core drill as a whole became stable and reliable.

The foregoing devices and processes are the subject of several issued Russian inventor's certificates.

2. The Present Invention

After testing the foregoing approach, it occurred to the inventor to seek a roller-bit hydraulic expander (underreamer) which would make it possible to underream shafts in one phase similar to the third method described above. The inventor accordingly developed an experimental sample of hydraulic roller-bit expander (underreamer) for core drill UKB-3.6, for pilot hole underreaming, the pilot hole being driven by a core drill from about 3.6M to about 5.6M. (See FIGS. 1, 2 and 3). The experimental sample of the expander was secured on the lid of the core drill.

Figure 1A:
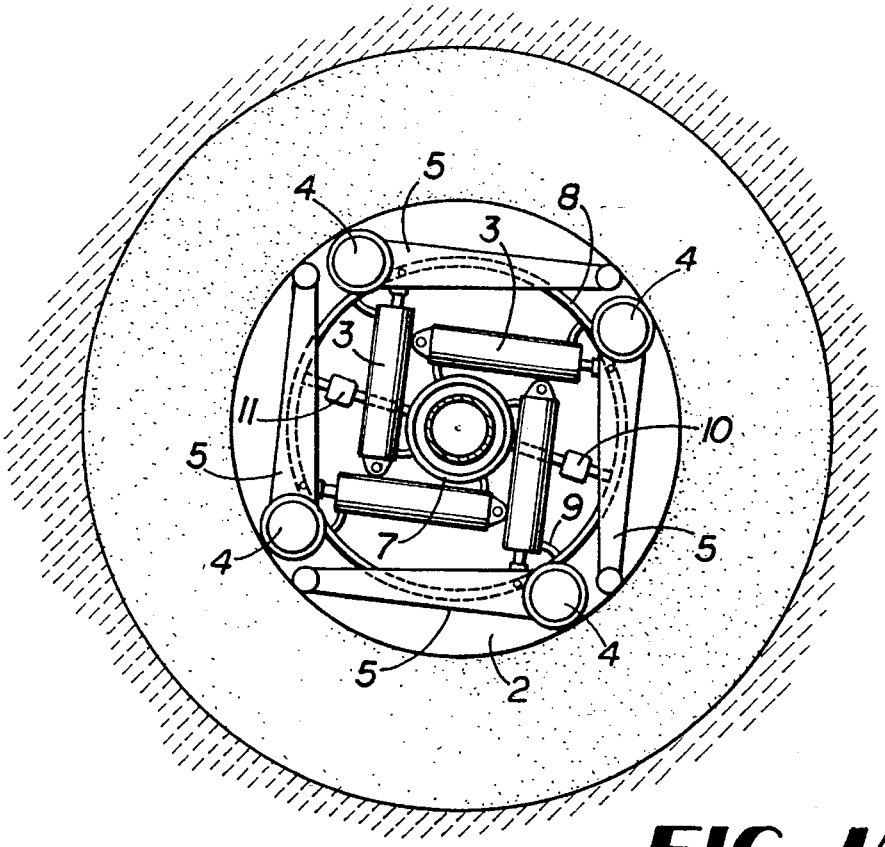
FIGS. 1A and 1B are plan views of an underreamer according to a preferred embodiment of the present invention.
Figure 1B:
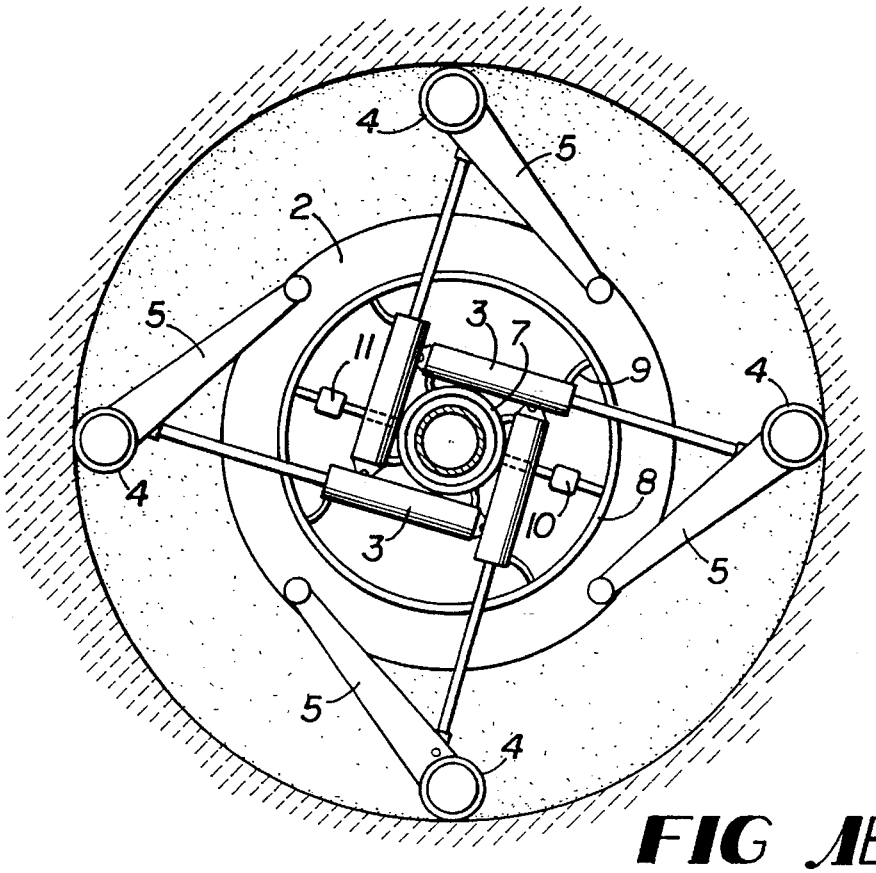
Figure 2:
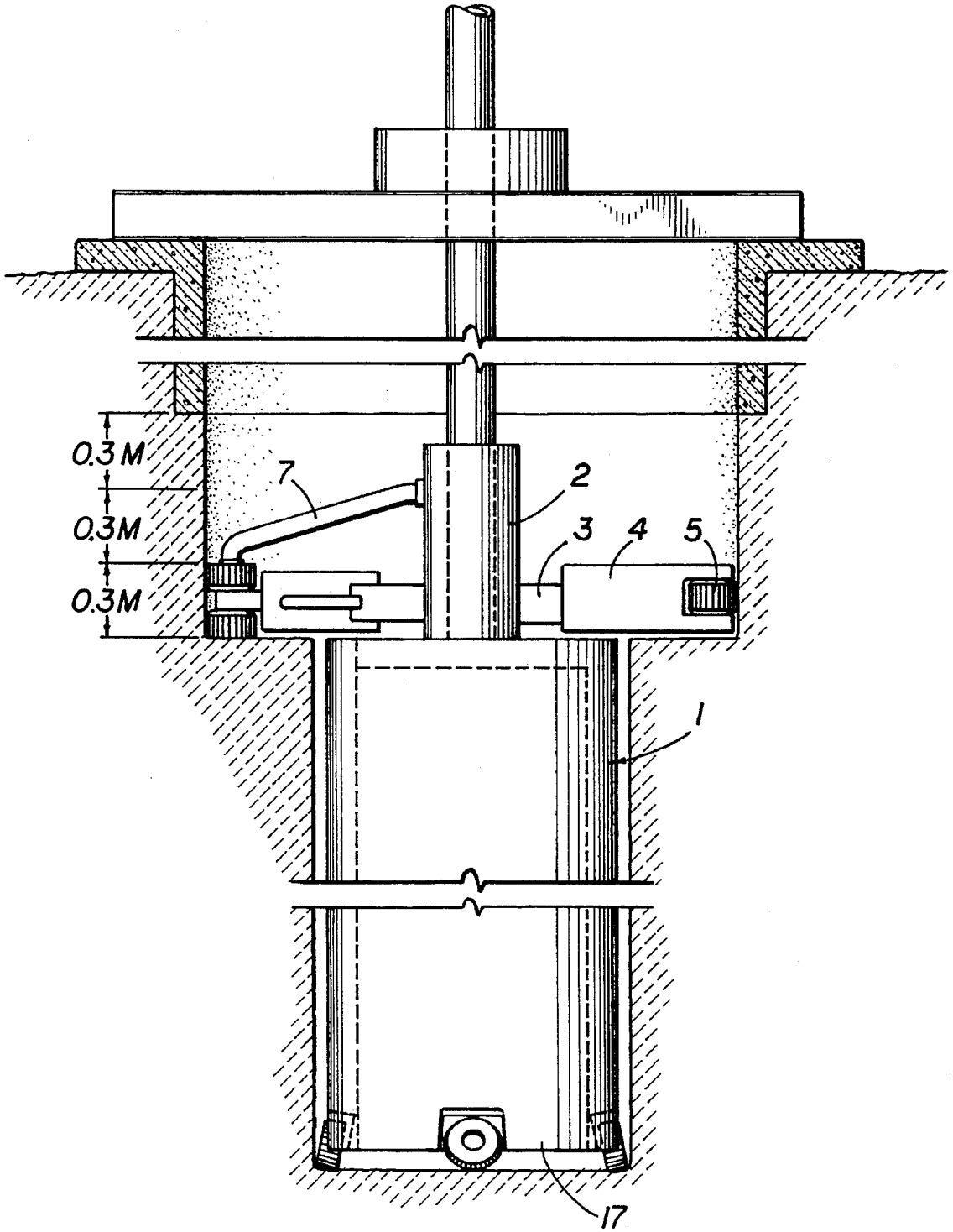
FIG. 2 is a cross sectional view of the underreamer shown in FIG. 1.
Figure 3A:
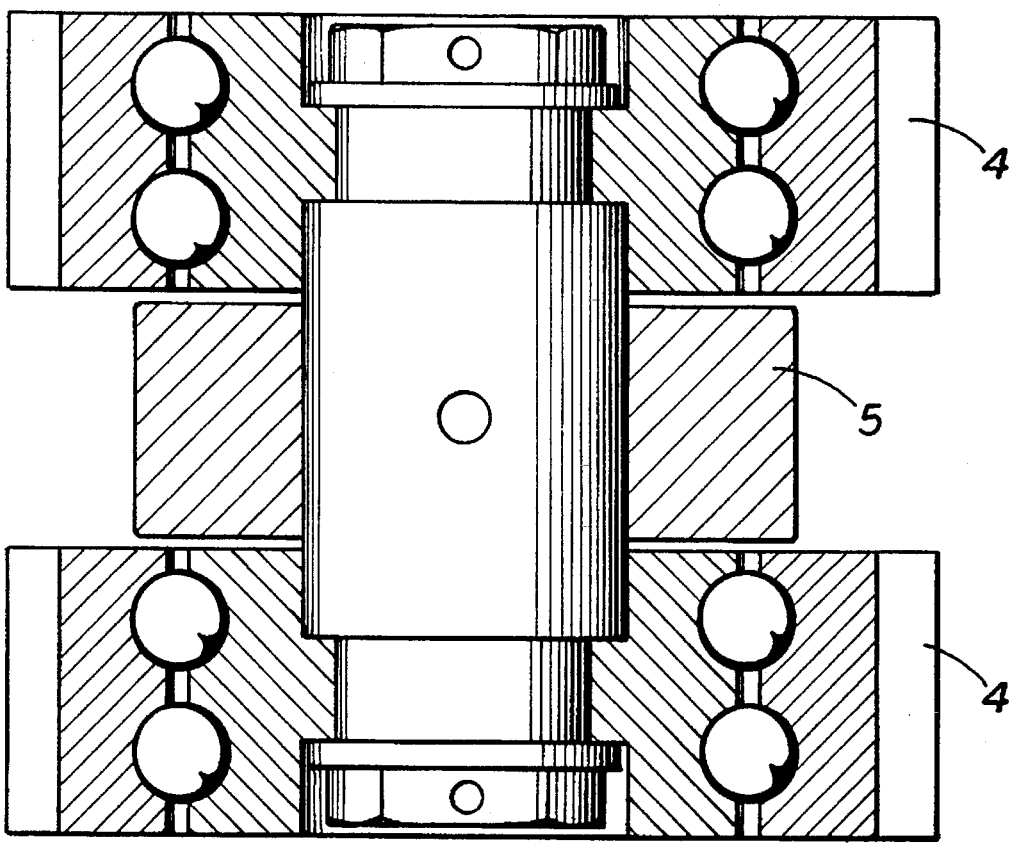
FIGS. 3A and 3B show roller cutters and their attachment to levers of the underreamer shown in FIG. 1.
Figure 3B:
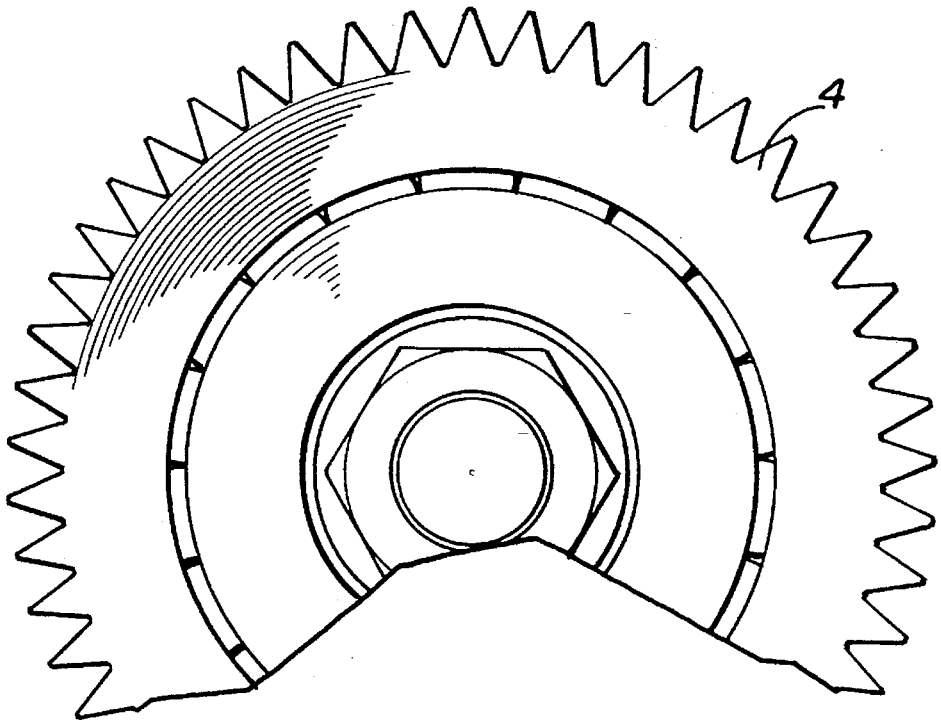

Some parts of the core drill were used in the underreamer: the driving roller cutters approximately 450 mm and the height of 100 mm, a hydraulic jack about 350 mm, the valve controlling the levers' operation and the pattern of the pipelines. FIG. 1A illustrates schematically the roller-bit expander in folded position and FIG. 1B shows it in fully unfolded position. FIG. 2 is a vertical cross sectional view of the expander, secured on the upper lid of a core drill. FIG. 3 shows the design of the roller-cutters in the place of their attachment to the lever.

The design of the expander, which may fit on core drill 1, is as follows as shown in FIGS. 1–4:

To the body 2 of the expander are mounted jacks 3, supporting roller-cutters 4, which are rotatably secured on levers 5. These components may be fashioned conventionally of conventional materials and connected conventionally as desired.

During the rotation of the drill, the jacks 3, in which the flush-out-fluid is being pumped in, force the roller-cutters 4 against the vertical face, causing (by rolling the roller-cutters 4 against the walls of the face) the crushing of the rock. The crushed rock is drawn to the surface by flush-out-fluid by the pattern of direct flushing out (that is when the fluid is pumped in along the drilling column, and returns along the whole profile of the shaft or is periodically removed by the means of a conventional vacuum device). Reaching the diameter of the shaft set by levers 5, the jacks 3 are returned to the initial position: the core drill with expander is lowered for the next cut and cycle is repeated. Collectors 7 and 8 and hoses 9 are used to pump the fluid to the jacks' cavities. A conventional ball centrifugal valve 10 and bypass valve 11 are employed for direct and reverse stroke of the jacks.

The hydraulic jacks, collectors, hoses and valves in the design of the expander may be of the type used from the undercutting mechanisms of the core drill UKB-3.6 mentioned above. The body and levers were manufactured anew.

An experimental drilling (underreaming) was carried out as follows using this design. The experiment tested the workability of the new design. A shaft, previously driven by a core drill, was underreamed from about 3.6 m to about 5.6 m to the depth of 100 m. More than 300 cycles of underreamings were made. In the experimental sample, the force applied to the roller-cutters of the expander was created (through the jacks) using flush out fluid at a pressure of 20 $Kg/cm^2$.

The lever mechanism operated successfully. The speed of underreaming was approximately 30 cm/hour on rock of hardness at 4 points of Protodiakonov scale and approximately 10 cm/hour on rock of 10 points hardness.

The tests proved workability of the principle pattern, but also proved it necessary to use jacks working on oil. The calculations of dynamics showed that the optimum pressure in the oil system is to be 200–400 $Kg/cm^2$ with the diameter of the jack about 200–250 mm. In that case the speed of underreaming on medium-hard rocks (4–6 points) is more than 100 cm/hour, and with hard rock (up to 12 points)—about 50 cm/hour. But to provide for the rigidness of the lever mechanism, it is reasonable to place the hydraulic system and the lever mechanism in the expanded (underreamed) part of the shaft, and the roller-cutters in the pilot hole. In this case the hydraulic system and the lever mechanism have no size restrictions and can be designed with any capacity to provide for the regime of bulk crushing of the rock, ensuring high speed of sinking. Placing the roller-cutters in the pilot hole makes it possible to reduce its diameter and increase the ratio of diameters in underreaming (up to 5:10 and more times).

The following are recommendations which may be considered when sinking a pilot hole according to the present invention:

1. Sink the pilot hole only to the height of the roller-cutters of the underreamer (that is approximately 0.3–0.5 m). The drilling is carried out by roller-bit equipment (starter), placed on the lower guiding device.

Each cycle of underreaming consists of the following operations:

(a) With the roller-cutters of the underreamer folded to the center, the starter makes the pilot hole 0.3–0.5M deep.

(b) The shaft is underreamed to the prescribed diameter.

(c) The roller-cutters are folded-back to the center of the underreamer.

Then the above-described cycle is continuously repeated.

Figure 4:
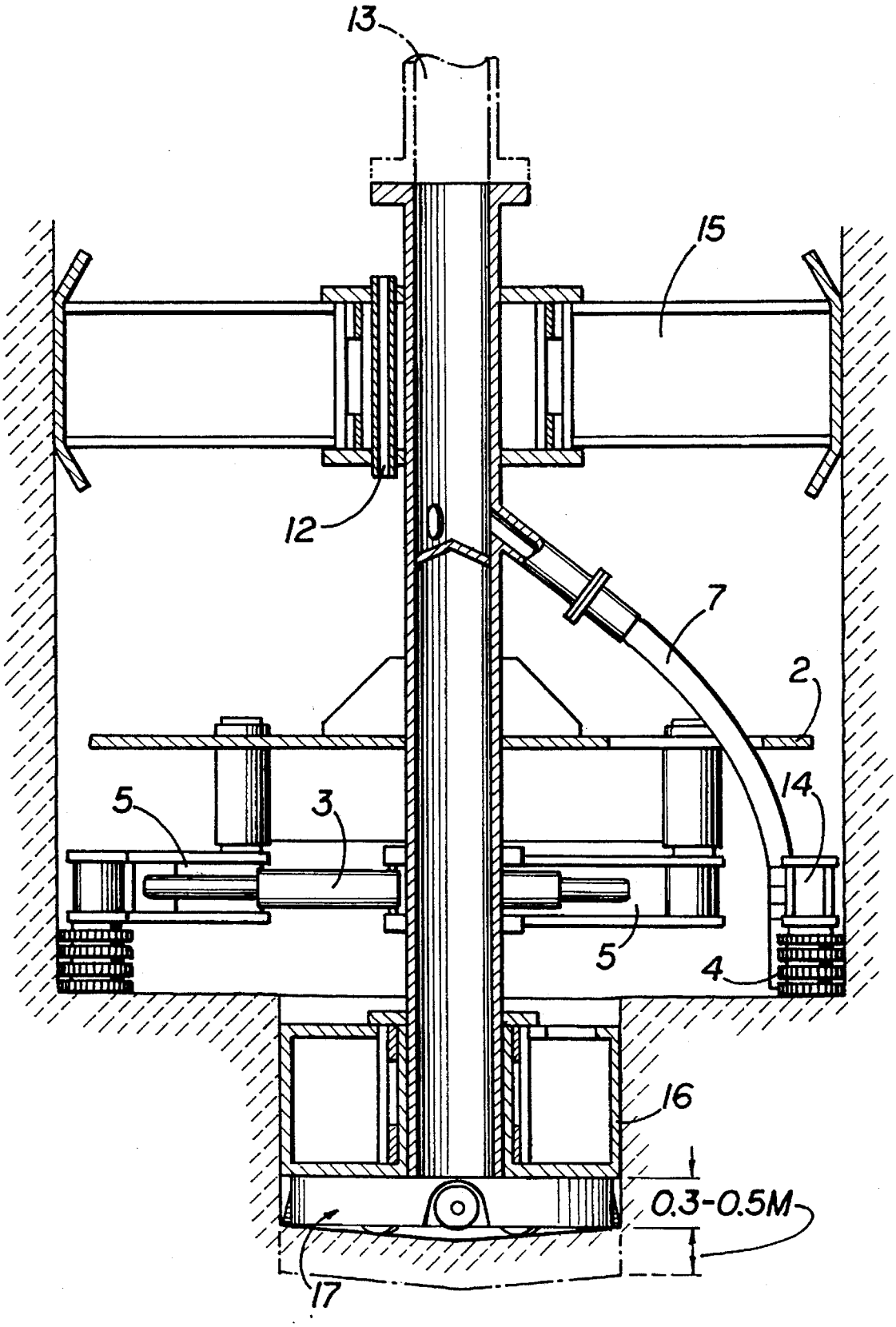
FIG. 4 is a schematic view of an underreamer of the present invention with a starter for sinking a pilot hole.

FIG. 4 shows an underreamer with the starter at the end of underreaming, which underreamer is sized to fit within the diameter of the already-underreamed portion. FIG. 4 shows the body of the underreamer 2, hydraulic jacks 3, roller cutters 4, levers 5, an oil line 12, a drilling column 13, a hose for pulp suction 7, a suction nozzle 14, an upper guiding device 15, a lower guiding device 16, and a starter 17. All of these components may be conventional.

When the levers are folded, the nozzle 14 may be secured co-axial to the pipeline of the starter's pulp removal (the pipeline is not shown in the drawing).

2. The drilling of the pilot hole to the depth of 50–100 and more meters by known methods, for example by a core drill, a drill with ballast fluid and others. The choice of the method is defined by the rock being drilled, by the sizes of the shaft (diameter, depth) and the drilling equipment.

The foregoing is provided for purposes of illustration, explanation and description of a preferred embodiment of the invention. Modifications and adaptations to this embodiment will be apparent to those of ordinary skill in the art and they may be made without departing from the scope or spirit of the invention.

What is claimed is:

1. A process for sinking a bore of large diameter, comprising the steps of:

a. providing an underreamer, comprising:
   (1) an expander body;
   (2) a plurality of levers, each rotatably mounted to the expander body so it is adapted to rotate beyond the periphery of the expander body;
   (3) a plurality of roller-cutters, each rotatably mounted to a lever; and
   (4) a plurality of jacks, each mounted to a lever and adapted to apply pressure to the lever so as to force the roller-cutters against rock outside the periphery of the expander body;

b. attaching the expander body to a starter;

c. with the roller cutters of the underreamer folded inward, sinking a pilot hole approximately to the height of the roller cutters;

d. actuating the jacks to cause the roller cutters to underream the bore;

e. folding the roller cutters of the underreamer inward; and f. repeating steps (c) through (e).

2. A process according to claim 1 further comprising the steps of introducing flush out fluid into the bore and using it to remove rock underreamed by the underreamer.

* * * * *